US007611555B2

(12) United States Patent
Wattenberg et al.

(10) Patent No.: US 7,611,555 B2
(45) Date of Patent: Nov. 3, 2009

(54) VACUUM CLEANER BAG

(75) Inventors: Heinz-Friedrich Wattenberg, Vlotho (DE); Bernd Wehage, Porta Westfalica (DE)

(73) Assignee: WOLF GmbH, Vlotho (DE)

( * ) Notice: Subject to any disclaimer, the term of this patent is extended or adjusted under 35 U.S.C. 154(b) by 423 days.

(21) Appl. No.: 11/582,384

(22) Filed: Oct. 18, 2006

(65) Prior Publication Data

US 2007/0084166 A1 Apr. 19, 2007

(30) Foreign Application Priority Data

Oct. 18, 2005 (DE) ..... 20 2005 016 309 U

(51) Int. Cl.
*A47L 9/14* (2006.01)

(52) U.S. Cl. ..... 55/369; 55/374; 55/381; 55/361; 55/367; 55/373; 55/376; 55/377; 55/378; 55/DIG. 2; 55/DIG. 3; 55/380; 15/347; 15/352; 15/DIG. 8; 383/120; 383/907

(58) Field of Classification Search ..... 55/369, 55/374, 381, 361, 367, 373, 376–378, DIG. 2, 55/DIG. 3, 380; 15/347, 352, DIG. 8; 383/120, 383/907

See application file for complete search history.

(56) References Cited

U.S. PATENT DOCUMENTS 3,107,989 A * 10/1963 Fesco ..... 55/381
3,404,515 A * 10/1968 Fesco ..... 55/377
3,421,683 A * 1/1969 Fesco ..... 55/361
3,596,443 A 8/1971 Goldberg
3,738,091 A * 6/1973 Fesco ..... 55/367
4,240,813 A * 12/1980 Fesco ..... 55/381
4,322,259 A * 3/1982 Fesco ..... 156/203
6,071,322 A * 6/2000 Hulthen ..... 55/367

FOREIGN PATENT DOCUMENTS

DE 73 02 545 U 1/1973
DE 101 26 425 A1 2/2002
DE 20 2005 000 918 U1 5/2005
JP 08 071 021 A 3/1996

OTHER PUBLICATIONS

German Search Report dated Aug. 23, 2006, issued in DE 20 2005 0116 309.

* cited by examiner

*Primary Examiner*—Duane Smith
*Assistant Examiner*—Minh-Chau T Pham
(74) *Attorney, Agent, or Firm*—Venable LLP; Robert Kinberg; Justine A. Gozzi

(57) ABSTRACT

A vacuum cleaner bag includes a bottom part having a substantially rectangular base section. A projecting section is disposed proximate to at least one side of the base section. The projecting section, when folded up for the storage position, rests on the base section. Sidewall sections extend peripherally in a direction away from the bottom part to form an inside space.

11 Claims, 1 Drawing Sheet

VACUUM CLEANER BAG

CROSS-REFERENCE TO RELATED APPLICATION

This application claims the priority of German Utility Patent Application No. 20 2005 016 309.0, filed Oct. 18, 2005, the subject matter of which is incorporated herein by reference in its entirety.

BACKGROUND

The present application relates to vacuum cleaners. More specifically, it relates to the vacuum cleaner bags and will be described with particular reference thereto. However, it is to be appreciated that the following may find applications in other systems and apparatuses in which expandable sections and the like are used.

German patent document DE 20 2005 000 918 discloses a dust filter bag, provided with an inlet opening in the front wall, which is surrounded by a flexible filter material consisting of a weldable material. Since the dust filter bag is to have a large inside volume following the expansion, projections are formed on the side onto the sidewalls to permit the volume expansion. The disadvantage of vacuum cleaner bags of this type is that they cannot be adapted easily to the respective shape of the vacuum cleaner chambers. In addition, the seams represent particularly high-stress areas where damage might occur. If the vacuum cleaner bags are folded up, they may not open easily and thus may not reach their full effectiveness.

Also known are vacuum cleaner bags having a massive or block bottom portion in the form of a rectangle, from which a flexible bag extends substantially in a perpendicular direction. Inside folds are provided at opposite-arranged sidewalls of the bag, so that the bag on one hand can be adapted easily to the form of the vacuum cleaner chamber and, on the other hand, can open up easily. However, the inside folds reduce the volume of the vacuum cleaner bag and furthermore increase the costs of producing the vacuum cleaner bags.

The following methods and apparatuses overcome the aforementioned problems and others.

SUMMARY

A vacuum cleaner bag is disclosed which in an exemplary embodiment includes a bottom part including a substantially rectangular base section. A projecting section is disposed proximate to at least one side of the base section. The projecting section, when folded up for the storage position, rests on the base section. Sidewall sections extend peripherally in a direction away from the bottom part to form an inside space.

BRIEF DESCRIPTION OF THE DRAWINGS

These and other features and advantages of the application will be further understood from the following detailed description of the preferred embodiments with reference to the accompanying drawings, which show in.

DETAILED DESCRIPTION OF AN EXEMPLARY EMBODIMENT

Figure 1:
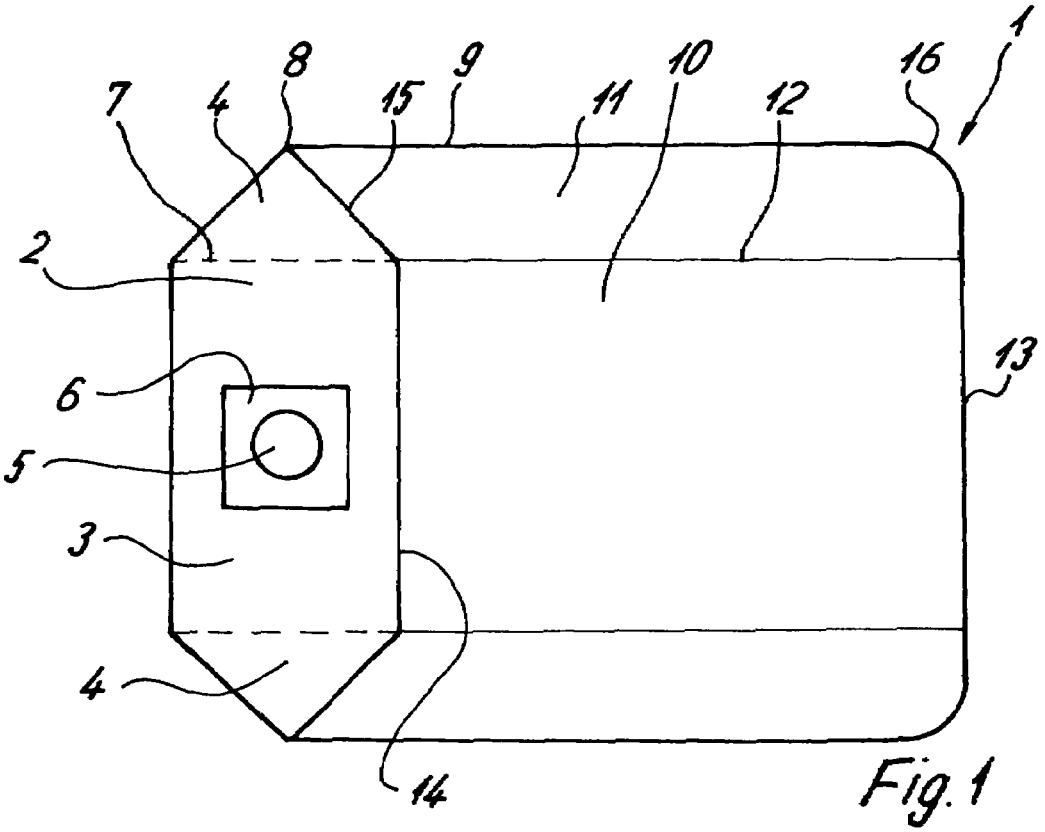
FIG. 1 An exemplary embodiment of a vacuum cleaner bag in the unfolded state.

A vacuum cleaner bag 1 includes a bottom part 2 including a base section 3. Sidewall sections 10 and 11 extend peripherally in one direction proximate the base section 3 to form a closed inside space. The base section 3, for example, has a substantially rectangular shape. Triangular-shaped projecting sections 4 are formed on shorter opposite sides of the bottom part 2 and are connected via a folding edge 7 to the base section 3. For example, the vacuum cleaner bag is symmetrical to a center plane to permit an easier installation. An inflow opening 5 is provided in the base section 3 of the bottom part 2 for inserting a connecting sleeve of a vacuum cleaner (not shown). The inflow opening 5 is surrounded by a support plate 6.

For example, the vacuum cleaner bag 1 includes one, two, three, four, etc. layers of a nonwoven material. The layers are welded together along joining regions.

As another example, the vacuum cleaner bag 1 can be embodied as a paper bag. The support plate 6 can likewise be produced from cardboard or plastic. The block bottom can be composed of a filter material or a material with higher rigidity.

Each projecting section 4 forms a tip 8 at opposite sides of the bottom part 2. Each tip 8 is adjacent a respective side edge 9 disposed between two folding sections of the sidewall sections 11 on each side of the sidewall 10. Proximate to the bottom part 2, the sidewall sections 11 are embodied at an angle relative to the sidewall section 10 adjacent a longitudinal edge 14 of the base section 3. Each sidewall section 11 is adjacent a side edge 15, disposed between the sidewall section 11 and the projecting section 4. In the unfolded state, the sidewall sections 10 and 11 extend substantially perpendicular to the bottom part 2 with the base section 3 and the projecting sections 4. A side edge 12 is disposed between the sidewall sections 10 and 11 and extends up toward an edge 13, which is arranged on the end of the bag opposite the bottom part 2. The sidewall sections 10 and 11 are joined together along the edge 13, with the aid of a welded or glued seam. A rounded or beveled section 16 is provided at the transition between the side edge 9 and the edge 13 to facilitate the unfolding of the vacuum cleaner bag 1 and to prevent any dead space in the corner.

Figure 2:
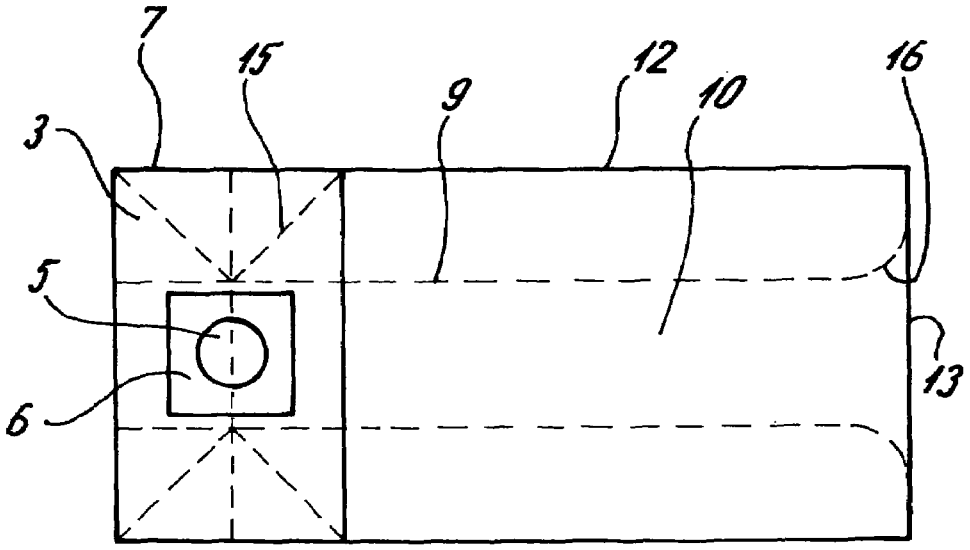
FIG. 2 The vacuum cleaner bag according to FIG. 1 in the folded-up state.

FIG. 2 shows the vacuum cleaner bag 1 in the folded-up state. The side edge 9 is arranged to fit inside the opposite-positioned sidewall sections 10. The projecting sections 4, proximate the shorter sides of the base section 3, are folded inward and rest flat on the base section 3. As illustrated, the bottom part 2 includes three sections: the folded-in projecting sections 4 on the opposite-arranged sides and the support plate 6 with the inflow opening 5 in the center. Dashed lines indicate the folding edges 9 and 15.

In the folded state, the vacuum cleaner bag 1 has a compact design and can be stored and transported easily. However, the projecting sections 4 can be unfolded easily for a use or operation position to provide the vacuum cleaner bag 1 with a large inside volume for dust storage. In addition, the form of the vacuum cleaner bag 1 can be adapted easily to different geometries as for example a cube-shaped chamber inside a vacuum cleaner since the sidewalls extend in one direction from the bottom, preferably at a substantially right angle.

In one embodiment, the bottom part 2 with the support plate 3 and the projecting sections 4 are fabricated from a material with higher rigidity than the sidewall sections 10 and 11 for a stabler assembly. In addition, assembly aids and guide elements can be provided on the bottom part 2. The vacuum cleaner bag 1 can furthermore be produced uniformly of the same type of material.

In the illustrated exemplary embodiment, the projecting sections 4 are triangular in shape. Of course, it is contemplated to vary the geometry of the projecting sections 4. For example, the projecting sections 4 can have rounded geometry, a trapezoid geometry and/or can be provided with a rounded tip 8.

It will be understood that the above description is susceptible to various modifications, changes and adaptations, and the same are intended to be comprehended within the meaning and range of equivalents of the appended claims.

What is claimed is:

1. A vacuum cleaner bag, comprising:

a bottom part including:

a substantially rectangular base section including an inside surface and an outside surface, and a projecting end section disposed proximate to at least one side of the base section, the projecting end section being foldable along the one side of the base section; and sidewall sections extending peripherally in a direction away from the bottom part, the base section together with the sidewalls defining a closed inside space of the vacuum cleaner bag;

wherein the vacuum cleaner bag includes an unfolded state and a folded-up state, and in the folded-up state an inside of the projecting end section is foldable to rest on the inside surface of the base section and in the unfolded state, the projecting end section extends outwardly of the base section.

2. The vacuum cleaner bag according to claim 1, wherein the projecting end section includes:

projecting sections each disposed proximate to a respective one of opposite sides of the base section.

3. The vacuum cleaner bag according to claim 1, wherein the projecting end section has a substantially triangular shape.

4. The vacuum cleaner bag according to claim 1, wherein at least one of the sidewall sections includes a first folding sidewall section and a second folding sidewall sections that come together at a side edge, and the projecting end section presents a tip that adjoins the side edge.

5. The vacuum cleaner bag according to claim 4, wherein the side edge has:

a folded-in storage position when the vacuum cleaner bag is in the fold-up state, such that the side edge fits inside the sidewall sections so that a surface of the first folding sidewall section contacts a surface of the second folding sidewall section, and a use position when the vacuum cleaner bag is in the unfolded state in which the side edge projects outward of the sidewall sections so that the surfaces of the first folding sidewall section and the second folding sidewall section do not contact each other.

6. The vacuum cleaner bag according to claim 4, wherein the sidewall sections are joined in a joining area at an end of the bag opposite the bottom part; to form an edge, and further including:

a transition area between the edge and the side edge and between the first and second folding sidewall sections, wherein the transition area is one of rounded or beveled.

7. The vacuum cleaner bag according to claim 6, wherein the sidewall sections include:

one or several layers of nonwoven material that are welded together at least along the joining area.

8. The vacuum cleaner bag according to claim 1, further including:

an inflow opening disposed in one of (1) the base section of the bottom part or (2) one of the sidewall sections.

9. The vacuum cleaner bag according to claim 8, further including:

a support plate attached to the base section and surrounding the inflow opening.

10. The vacuum cleaner bag according to claim 1, wherein the sidewall sections are connected to the bottom part and are joined to each other on an end of the bag opposite the bottom part to form the inside space.

11. The vacuum cleaner bag according to claim 1, wherein the bottom part includes:

a material having a higher rigidity than a material from which the sidewall sections are fabricated.

* * * * *

UNITED STATES PATENT AND TRADEMARK OFFICE

CERTIFICATE OF CORRECTION

PATENT NO. : 7,611,555 B2
APPLICATION NO. : 11/582384
DATED : November 3, 2009
INVENTOR(S) : Wattenberg et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 439 days.

Signed and Sealed this

Twelfth Day of October, 2010

David J. Kappos

David J. Kappos
*Director of the United States Patent and Trademark Office*